US005935900A

United States Patent [19]

Meguro et al.

[11] Patent Number: 5,935,900

[45] Date of Patent: Aug. 10, 1999

[54] HEAT SENSITIVE RECORDING MATERIAL

[75] Inventors: Tatsuya Meguro; Naoko Inatsu; Tetsuo Tsuchida, all of Amagasaki, Japan

[73] Assignee: Ojl Paper Co., Ltd., Tokyo, Japan

[21] Appl. No.: 08/911,166

[22] Filed: Aug. 14, 1997

[30] Foreign Application Priority Data

Aug. 29, 1996 [JP] Japan ..... 8-248752

[51] Int. Cl.[6] ..... B41M 5/30; B41M 5/40

[52] U.S. Cl. ..... 503/209; 427/152; 503/200; 503/208; 503/216; 503/226

[58] Field of Search ..... 427/150–152; 503/208, 209, 216, 217, 225, 221, 226

[56] References Cited

U.S. PATENT DOCUMENTS 5,128,309 7/1992 Iwakura et al. ..... 503/209

FOREIGN PATENT DOCUMENTS 0 191 582 A1 8/1986 European Pat. Off. .
0 280 650 A1 8/1988 European Pat. Off. .
0 593 936 A1 4/1994 European Pat. Off. .
0 613 789 A1 9/1994 European Pat. Off. .
0 630 758 A2 12/1994 European Pat. Off. .
7-149046 6/1995 Japan .

*Primary Examiner*—Bruce Hess
*Attorney, Agent, or Firm*—Kubovcik & Kubovcik

[57] ABSTRACT

The present invention provides a heat sensitive recording material comprising a heat sensitive recording layer formed on a substrate and containing an electron-donating compound and an electron-accepting compound, and a protective layer formed on the recording layer when required, the recording material being characterized in that at least one benzotriazole compound represented by the formula (1) is incorporated into at least one of the heat sensitive recording layer and the protective layer (1)

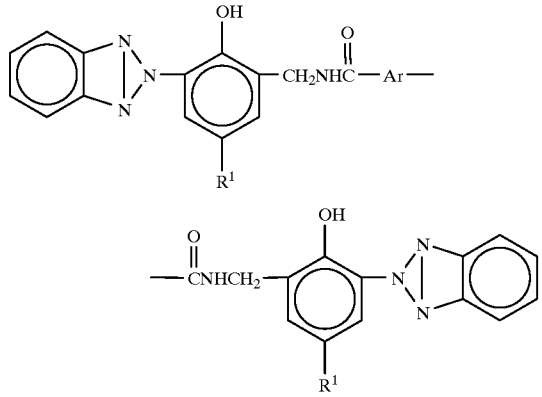

wherein $R^1$ is $C_{1\sim4}$ alkyl, Ar is 1,3-phenylene or 1,4-phenylene.

6 Claims, No Drawings

HEAT SENSITIVE RECORDING MATERIAL

The present invention relates to heat sensitive recording materials having an improved light resistance in both the recorded and unrecorded areas without any detrimental effects being caused on their properties.

Heat sensitive recording materials are well known which thermally bring plural chromogenic substances into contact with each other to obtain recorded images. Those heat sensitive recording materials are relatively inexpensive, while recording devices therefor are compact and relatively easy to maintain, so that these materials serve as recording media for facsimile systems, various types of calculating machines, etc. and are also used in a wide variety of fields.

Generally, heat sensitive recording materials have problems in that, when exposed to sunlight or indoor light for a long period of time, the background areas (unrecorded areas) will turn into yellow and the recorded images will become gradually discolored.

In addition, as a way of expanding the fields of utilization for heat sensitive recording materials, there is, for instance, the heat sensitive recording labels which are used in the POS (point of sales) systems. With the expansion of the POS systems, apart from their application as labels to be attached on foodstuffs, which have only a limited span of useful life, there are increasing demands for their applications as tags which are attached on goods and used for a long period of time, or as sheets of paper for use in handy type terminal printers which are often employed outdoors when performing delivering and collecting operations. However, when used in such applications, heat sensitive recording materials are often exposed to sunlight or indoor light for a long period of time, and under the influence therefrom, the recorded images formed thereon will become discolored, or the background areas will turn yellow, thereby causing a remarkable deterioration in the images of goods.

Accordingly, there has been a strong demand for such heat sensitive recording materials as will have excellent light resistance so that they will develop only a low level of discoloration in the recorded images, or of color change into yellow of the background areas even if they are exposed to sunlight or indoor light for a long period of time.

In addition, it is also required that the heat sensitive recording materials as described above which are used as tags or sheets of paper for handy type terminal printers have resistance of the recorded images against chemicals such as plasticizers, oils or solvents as with the heat sensitive recording labels for use on foodstuffs.

Further, these heat sensitive recording materials are sometimes exposed to high temperature environments and are required to possess resistance to heat.

Conventionally, in order to improve the light resistance of heat sensitive recording materials, various methods for incorporating a benzotriazole compound into the heat sensitive recording layer were disclosed in JP-B- 23205/1978, JP-A-55891/1980, JP-A-307981/1988, JP-A-23986/1991, JP-A-8545/1993, etc. Furthermore, for the purpose of improving the chemical resistance of the heat sensitive recording material, methods for incorporating a benzotriazole compound into the heat sensitive recording layer were disclosed in JP-A-87093/1983, JP-A-15783/1988, etc.

Also, for improving the chemical resistance of the heat sensitive recording material, a number of methods for forming a protective layer on the heat sensitive recording layer were disclosed in JP-A-128347/1979, JU-B-9909/1984, JU-B-26216/1987, etc.

Furthermore, for improving the light resistance of the heat sensitive recording material, methods for adding a pulverized benzotriazole compound to the protective layer which is formed on the recording layer were disclosed in JP-A-107388/1985, JP-A-112487/1985, JP-A-193883/1986, etc.

However, if a conventionally proposed method of adding to the heat sensitive recording layer a benzotriazole compound such as 2-(2'-hydroxy-5'-methylphenyl)benzotriazole is employed to obtain sufficient light resistance, it is necessary to use a comparatively large amount of the compound in view of the absorption efficiency of ultraviolet light, in other words, the shielding efficiency of ultraviolet light, which contributes to damaging the basic properties of the heat sensitive recording material, for instance, by lowering record sensitivity or by giving rise to background fogging if they are placed under high temperature environments. In addition, the improvements of chemical resistance achieved by adding those benzotriazole compounds to the heat sensitive recording layer do not have as large and satisfactory effects as can be achieved by the formation of the protective layer.

On the other hand, the method for adding a benzotriazole compound to the protective layer which is formed on the heat sensitive recording layer has problems in that if compounds such as the conventionally proposed 2-(2'-hydroxy-5'-methylphenyl)benzotriazole are employed, because of their melting point being relatively low, those compounds will melt during recording and cause a sticking between the thermal head and the protective layer, thus preventing the recorded images from being formed in a uniform fashion. Also, depending on the kinds of chemicals, those compounds will elute, causing the protective layer to lose their function as barrier, which results in the reduction of the chemical resistance of the recorded images.

Further, JP-A-149046/1995 discloses an addition of 2,2'-methylenebis[4-(1,1,3,3-tetramethylbutyl)-6-(2H-benzotriazol-2-yl)phenol] to the heat sensitive recording layer or the protective layer formed on the heat sensitive recording layer in order to improve resistance to light. However, this benzotriazole compound still damages the basic properties of the heat sensitive recording material, although less than that of the conventional 2-(2'-hydroxy-5'-methylphenyl)benzotriazole, and is also unsatisfactory in improving the resistance to light.

In view of the above-mentioned situation, a purpose of the present invention is to provide a heat sensitive recording material which has an improved light resistance in both the recorded and unrecorded areas without any detrimental effects being caused on their basic properties as described above, as well as those which are excellent not only in light resistance in connection with the recorded and unrecorded areas but also in recording property such as head matching ability, and resistances to chemicals such as plasticizers, oils and solvents.

The present invention provides a heat sensitive recording material comprising a heat sensitive recording layer formed on a substrate and containing an electron-donating compound and an electron-accepting compound, and a protective layer formed on the recording layer when required, the recording material being characterized in that at least one benzotriazole compound represented by the formula (1) is incorporated into at least one of the heat sensitive recording layer and the protective layer (1)

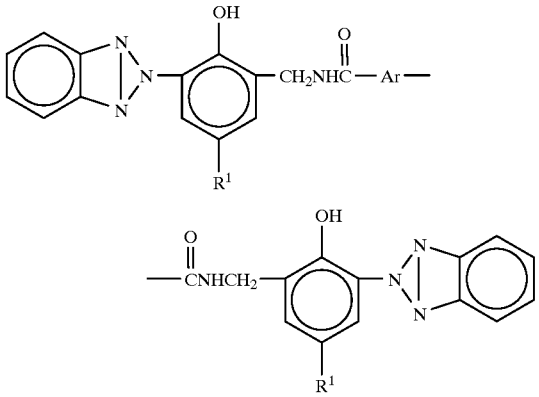

wherein $R^1$ is $C_{1-4}$ alkyl, Ar is 1,3-phenylene or 1,4-phenylene.

According to the present invention, the heat sensitive recording material has the heat sensitive recording layer containing an electron-donating compound and an electron-accepting compound, and the protective layer when required, successively provided on the substrate; and at least one of the specific benzotriazole compounds represented by the above formula (1) is incorporated into at least one of the heat sensitive recording layer and the protective layer, so that the light resistance in the recorded and unrecorded areas is remarkably improved as compared with the conventionally proposed benzotriazole compounds. The specific benzotriazole compounds mentioned above afford an extremely low level of background fogging under high temperature environments even when they are incorporated into the recording layer. Moreover, since those specific benzotriazole compounds hardly dissolve into solvents such as plasticizers, oils and organic solvents, their employment in the protective layer does not cause the surfaces of the protective layer to reduce their function as a barrier caused by the elution of ultraviolet absorbers, when they come into contact with those solvents, which exhibits an excellent improvement in the chemical resistance. Furthermore, they contribute to a remarkable improvement in the recording property without sticking or adhesion of tailings to the thermal head due to the melting while a recording is performed by the thermal head.

According to the present invention, a desired effect can be achieved by incorporating the specific benzotriazole compound into at least one of the heat sensitive recording layer and the protective layer. Of course, they can be incorporated into both the heat sensitive recording layer and the protective layer. They may also be incorporated only into the recording layer of the heat sensitive recording material which is provided with a protective layer. In view of the shielding efficiency of ultraviolet light, it is better for the specific benzotriazole compound to be contained in the protective layer rather than in the recording layer.

Examples of benzotriazole compounds of the formula (1) are N,N'-bis[2-hydroxy-3-(2H-benzotriazol-2-yl)-5-methylbenzyl]-1,4-benzenedicarboxamide, N,N'-bis[2-hydroxy-3-(2H-benzotriazol-2-yl)-5-ethylbenzyl]-1,4-benzenedicarboxamide, N,N'-bis[2-hydroxy-3-(2H-benzotriazol-2-yl)-5-isopropylbenzyl]-1,4-benzenedicarboxamide, N,N'-bis[2-hydroxy-3-(2H-benzotriazol-2-yl)-5-sec-butylbenzyl]-1,4-benzenedicarboxamide, N,N'-bis[2-hydroxy-3-(2H-benzotriazol-2-yl)-5-tert-butylbenzyl]-1,4-benzenedicarboxamide, N,N'-bis[2-hydroxy-3-(2H-benzotriazol-2-yl)-5-methylbenzyl]-1,3-benzenedicarboxamide, N,N'-bis[2-hydroxy-3-(2H-benzotriazol-2-yl)-5-ethylbenzyl]-1,3-benzenedicarboxamide, N,N'-bis[2-hydroxy-3-(2H-benzotriazol-2-yl)-5-isopropylbenzyl]-1,3-benzenedicarboxamide, N,N'-bis[2-hydroxy-3-(2H-benzotriazol-2-yl)-5-sec-butylbenzyl]-1,3-benzenedicarboxamide and N,N'-bis[2-hydroxy-3-(2H-benzotriazol-2-yl)-5-tert-butylbenzyl]-1,3-benzenedicarboxamide, etc. Of course, the benzotriazole compound is not limited to the above and can be used in a combination of at least two of them as required.

Among these benzotriazole compounds preferable is N,N'-bis[2-hydroxy-3-(2H-benzotriazol-2-yl)-5-methylbenzyl]-1,4-benzenedicarboxamide which affords a heat sensitive recording material having excellent resistances to chemicals such as plasticizer and oil.

It is preferable that the benzotriazole compound be pulverized and incorporated into the heat sensitive recording layer or the protective layer. For pulverization, the benzotriazole compound is dispersed individually or as required together with additives such as a dispersant or defoaming agent, into water serving as a dispersing medium, using stirring and pulverizing means such as a ball mill, attritor or sand mill.

The average particle diameter of the pulverized benzotriazole compound is preferably 2.0 $\mu$m or less. Particularly, the reduction of the average diameter to 1.0 $\mu$m or less contributes to a remarkable improvement of the absorption efficiency of ultraviolet light. If the benzotriazole compound of this particle size is incorporated into the protective layer, it also affords more clear recorded images without shading the recorded images, while enhancing the chemical resistance of the protective layer through improvement of their film forming ability.

The heat sensitive recording systems according to the present invention which utilize the color forming reaction between the electron-donating compound and the electron-accepting compound include, for instance, the combination of leuco dye with color acceptor, the combination of diazonium salt with coupler, the combination of organic acid salt of a transition element such as iron with chelating reagent, the combination of aromatic isocyanate compound with imino compound, etc. However, since the combination of leuco dye with color acceptor is excellent in both the color density and the recording sensitivity, a detailed description shall be given below of the heat sensitive recording material which utilizes the color forming reaction between leuco dye and color acceptor.

Various known leuco dyes are usable as the leuco dye. Examples thereof are 3,3-bis(p-dimethylaminophenyl)-6-dimethylaminophthalide, 3-cyclohexylamino-6-chlorofluoran, 3-diethylamino-6-methyl-7-chlorofluoran, rhodamine(o-chloroanilino)lactam, 3-(N-ethyl-p-toluidino)-7-methylfluoran, 3-diethylamino-6,8-dimethylfluoran, 3-(N-ethyl-N-isoamylamino)-6-methyl-7-anilinofluoran, 3-(N-methyl-N-cyclohexylamino)-6-methyl-7-anilinofluoran, 3-diethylamino-6-methyl-7-anilinofluoran, 3-di-n-butylamino-6-methyl-7-anilinofluoran, 3-di-n-pentylamino-6-methyl-7-anilinofluoran, 3-di-n-butylamino-7-(o-chlorophenylamino)fluoran, 3-(N-ethyl-p-toluidino)-6-methyl-7-anilinofluoran, 3-diethylamino-7-(m-trifluoromethylanilino)fluoran, 3-(N-ethyl-N-tetrahydrofurfurylamino)-6-methyl-7-anilinofluoran, 3-diethylamino-6-chloro-7-anilinofluoran, 3-dimethylamino-6-methyl-7-anilinofluoran, 3-di-n-butylamino-6-methyl-7-m-toluidinofluoran, 3-(N-ethyl-N-ethoxypropylamino)-6-methyl-7-anilinofluoran, 3-(N-methyl-N-n-propylamino)-6-methyl-7-anilinofluoran, 3,3-bis[1-(4-methoxyphenyl)-1-(4-dimethylaminophenyl) ethylene-2-yl]-4,5,6,7-tetrachlorophthalide, 3-(4-dimethylaminophenylamino)-5,7-dimethylfluoran, 3-(4-di-n-butylaminophenylamino)-6-methyl-7-chlorofluoran and 3,3-bis(4-diethylamino-2-ethoxyphenyl)-4 -azaphthalide, etc. Of course, the leuco dye is not limited to the above and can be used in a combination of at least two of them as required. The amount of the leuco dye to be used is preferably 5 to 40% by weight based on the weight of the heat sensitive recording layer although not limited particularly.

Various known color acceptors can be used as a color acceptor which is conjointly used with the leuco dye. Examples thereof are 4,4'-isopropylidenediphenol, 1,1-bis (4-hydroxyphenyl)cyclohexane, 2,2-bis(4-hydroxyphenyl)-4-methylpentane, 1,1-bis(4-hydroxyphenyl)-1-phenylethane, 4,4'-dihydroxydiphenylsulfide, benzyl 4-hydroxybenzoate, 4,4'-dihydroxydiphenylsulfone, 2,4'-dihydroxydiphenylsulfone, 4-hydroxy-4'-isopropoxydiphenylsulfone, bis(3-allyl-4-hydroxyphenyl) sulfone, 4-hydroxy-4'-methyldiphenylsulfone, 4-hydroxyphenyl-4'-benzyloxyphenylsulfone, 3,4-dihydroxyphenyl-4'-methylphenylsulfone, bis(4-hydroxyphenylthioethoxy)methane, 1,4-bis(a -methyl-a -(4'-hydroxyphenyl)ethyl)benzene, 1,3-bis[α-methyl-α-(4'-hydroxyphenyl)ethyl]benzene, di(4-hydroxy-3-methylphenyl)sulfide, butyl bis(4-hydroxyphenyl)acetate and bis(4-hydroxyphenylthioethyl)ether and like phenolic compounds, N,N'-di-m-chlorophenylthiourea and like thiourea compounds, zinc salt of p-chlorobenzoic acid, zinc salt of 4-[2-(p-methoxyphenoxy)ethoxy]salicylic acid, zinc salt of 4-[3-(p-tolylsulfonyl)propyloxy]salicylic acid, zinc salt of 5-[p-(2-p-methoxyphenoxyethoxy)cumyl]salicylic acid, zinc salt of 4-octyloxycarbonylaminosalicylic acid and like zinc salt of aromatic carboxylic acids, N-(p-tolylsulfonyl)-N'-phenylurea, 4,4'-bis(p-tolylsulfonylurea)-diphenylmethane and like organic acidic substances. Of course, the color acceptor is not limited to the above and can be used in at least two of them as required. Among these color acceptors preferable are diphenylsulfone derivatives of the formula (2) below which afford a heat sensitive recording material having excellent preservability of the recorded images (2)

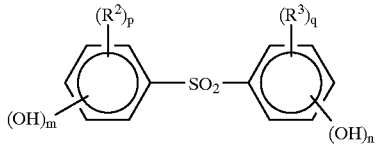

wherein $R^2$ and $R^3$ are each $C_1$~$C_4$ alkyl, $C_2$~$C_4$ alkenyl, $C_1$~$C_4$ alkoxyl, benzyloxy or halogen atom, m is 0 or an integer of 1 or n is 0 or an integer of 1 or 3, p and q are each an integer of 0 to 2.

Among the above color acceptors preferably used are 4-hydroxy-4'-isopropoxydiphenylsulfone, bis(3-allyl-4-hydroxyphenyl)sulfone and 2,4'-dihydroxydiphenylsulfone which afford a heat sensitive recording material having excellent preservability of the recorded images.

In case of obtaining a heat sensitive recording material having especially excellent heat resistance, preferably used is 1,1-bis(4-hydroxyphenyl)-1-phenylethane as the color acceptor.

It is desired that the ratio of the color acceptor to the leuco dye to be used therewith be adjusted generally within the range of 50 to 500 parts by weight, preferably about 100 to about 300 parts by weight, per 100 parts by eight of the leuco dye although not limited specifically and suitably selected depending on the kinds of the leuco dye and the color acceptor.

Further, in case of incorporating the specific benzotriazole compound into the heat sensitive recording layer, the amount of the compound is generally 10 to 500 parts by weight, preferably 20 to 200 parts by weight based on 100 parts by weight of the leuco dye although not limited particularly.

In the present heat sensitive recording material, it is possible to incorporate a sensitizer in order to improve record sensitivity, and a preservability improving agent in order to improve recorded image preservability.

Examples of useful sensitizers are stearic acid amide, methoxycarbonyl-N-stearic acid benzamide, stearic acid ethylenebisamide, stearic acid methylenebisamide, stearic acid N-methylolamide, dibenzyl terephthalate, benzyl p-benzyloxybenzoate, 2-naphthyl benzyl ether, m-terphenyl, dibenzyl oxalate, di-p-methylbenzyl oxalate, di-p-chlorobenzyl oxalate, p-benzylbiphenyl, di(p-methoxyphenoxyethyl) ether, 1,2-bis(3-methylphenoxy) ethane, 1,2-bis(4-methylphenoxy)ethane, 1,2-bis(4-methoxyphenoxy)ethane, 1,2-diphenoxyethane, 1-(4-methoxyphenoxy)-2-(3-methoxyphenoxy)ethane, p-methylthiophenyl benzyl ether, 1,4-di(phenylthio)butane, p-biphenyl-p-tolyl ether, N-acetoacetyl-p-toluidine, di(β-biphenylethoxy)-benzene, p-di(vinyloxyethoxy)benzene, 1-isopropylphenyl-2-phenylethane, 1-phenoxy-2-(2 -naphthoxy)ethane, 1,3-bis(2-naphthoxy)propane and 1-(2-naphthoxy)-2-(4-methylphenoxy)ethane.

Among these sensitizers preferably used are 1-phenoxy-2-(2-naphthoxy)ethane, 1,3-bis(2-naphthoxy)propane, 1-(2-naphthoxy)-2-(4-methylphenoxy)ethane, di-p-methylbenzyl oxalate and di-p-chlorobenzyl oxalate which can afford a heat sensitive recording material having an excellent preservability of the background area especially under high temperature environment.

Examples of useful preservability improving agents are 2,2'-methylenebis(4-methyl-6-tert-butylphenol), 2,2'-methylenebis(4-ethyl-6-tert-butylphenol), 4,4'-thiobis(2-methyl-6-tert-butylphenol), 1,1,3-tris(2-methyl-4-hydroxy-5-cyclohexylphenyl)butane, 1,1,3-tris(2-methyl-4-hydroxy-5-tert-butylphenyl)butane, 4,4'-thiobis(3-methyl-6-tert-butylphenol), 4,4'-dihydroxy-3,3',5,5'-tetramethyldiphenylsulfone, 2,2-bis(4-hydroxy-3,5-dichlorophenyl)propane, 2,2-bis(4-hydroxy-3,5-dimethylphenyl)propane and like hindered phenol compounds, 1,4-diglycidyloxybenzene, 4,4'-diglycidyloxydiphenylsulfone, 4-benzyloxy-4'-(2-methylglycidyloxy)diphenylsulfone, diglycidyl terephthalate, cresol novolak type epoxy resin, phenol novolak type epoxy resin, bisphenol A type epoxy resin and like epoxy compounds, N,N'-di-2-naphthyl-p-phenylenediamine, sodium salt or polyvalent metal salt of 2,2'-methylenebis(4,6-di-tert-butylphenyl)phosphoric acid and bis(4-ethyleneiminocarbonylaminophenyl)methane. Among these preservability improving agents preferably used is 1,1,3-tris(2-methyl-4-hydroxy-5-cyclohexylphenyl)butane which exhibits an effect in improving water resistance and is difficult to produce background fogging. It is desired that the amounts of the sensitizer and the preservability improving agent be adjusted generally within the range of up to 400 parts by weight per 100 parts by weight of the color acceptor although not limited specifically.

A coating composition for the heat sensitive recording layer is prepared by dispersing these components together with additives as required such as a dispersant or defoaming agent, into a dispersion medium which is generally water, at the same time or individually, with use of a stirring-pulverizing machine such as a ball mill, attritor or sand mill.

Usually a binder is incorporated into the coating composition for the heat sensitive recording layer in an amount of 10 to 40 wt.% , preferably 15 to about 30 wt. %, based on the total solids content of the heat sensitive recording layer. Examples of useful binders are starches, hydroxyethyl cellulose, methyl cellulose, carboxymethyl cellulose, gelatin, casein, gum arabic, polyvinyl alcohol, carboxyl-modified polyvinyl alcohol, acetoacetyl-modified polyvinyl alcohol, silicon-modified polyvinyl alcohol, diisobutylene-maleic anhydride copolymer salt, styrene-maleic anhydride copolymer salt, ethylene-acrylic acid copolymer salt, styrene-acrylic acid copolymer salt, styrene-butadiene copolymer emulsion, urea resin, melamine resin, amide resin, polyurethane resin, etc. At least two of these binders can of course be used in combination.

Various auxiliary agents can further be added to the coating composition. Examples of useful agents are surfactants such as sodium dioctylsulfosuccinate, sodium dodecylbenzenesulfonate, sodium salt of lauryl alcohol sulfuric acid ester and metal salts of fatty acids; lubricants such as zinc stearate and calcium stearate; waxes such as polyethylene wax, carnauba wax, paraffin wax and ester wax; inorganic pigments such as kaolin, clay, talc, calcium carbonate, aluminum hydroxide, calcined kaolin, titanium dioxide and amorphous silica; organic pigments such as styrene microball, nylon powder, polyethylene powder, urea-formaldehyde resin filler and raw starch particles; and other agents including defoaming agents, fluorescent dyes, coloring dye, etc.

With the heat sensitive recording material of the invention, the method of forming the recording layer is not limited specifically. The recording layer can be formed by a suitable method, for example, by applying a coating composition for forming this layer to a substrate with suitable means, such as air knife coating, VARI-BAR coating, pure blade coating, rod blade coating, short dwell coating, curtain coating or die coating, and drying the resulting coating. The amount of coating composition to be applied, which is not limited particularly, is usually 2 to 12 g/m$^2$, preferably 3 to 10 g/m$^2$, based on dry weight.

The substrate includes paper(including also acidic paper and neutralized paper), plastic film, synthetic paper, non-woven fabric, sheet having metal vapor-deposited and the like and is used as suitably selected.

In case of incorporating the specific benzotriazole compound into the protective layer, the amount of the compound is preferably 1 to 50 % by weight, more preferably 10 to 40% by weight based on the total solid contents of the protective layer although not limited particularly. If the amount of the specific benzotriazole compounds is less than 1% by weight relative to the total solids content of the protective layer, the light resistance of the recorded and unrecorded areas is reduced, and if it exceeds 50% by weight, it is likely that the film forming ability of the protective layer is reduced, resulting in the deterioration of the chemical resistance of the recorded images.

For the water-soluble or water-dispersible binders which are incorporated into the protective layer, various binders which are used in the above heat sensitive recording layer can be used. Preferable among them are carboxyl-modified polyvinyl alcohol, acetoacetyl-modified polyvinyl alcohol, and silicon-modified polyvinyl alcohol, because of their excellent efficiency as a protective layer. Particularly, acetoacetyl-modified polyvinyl alcohol is most preferred, since it easily enhances the chemical resistance and water resistance of the protective layer. Acetoacetyl-modified polyvinyl alcohol is derived from the acetoacetic acid esterification of polyvinyl alcohol having a polymerization degree of 200 to 2000. The acetoacetic acid esterification of polyvinyl alcohol can be accomplished by adding diketene to polyvinyl alcohol resin, or by the process of the ester exchange of acetoacetic acid ester. The content of the binder is preferably in the range of 15 to 80% by weight based on the total solid contents of the protective layer.

To improve the printability or prevent the recording material from sticking to the recording head, it is possible to add to the protective layer as required an inorganic pigment such as calcium carbonate, zinc oxide, aluminum oxide, titanium oxide, silicon dioxide, aluminum hydroxide, barium sulfate, talc, kaolin, clay and colloidal silica, or organic pigment such as styrene microball, nylon filler, urea-formaldehyde resin filler and raw starch particles. It is desired the amount of the pigment be 5 to 500 parts by weight based on 100 parts by weight of the binder.

Various auxiliary agents can further be added as required to the coating composition for the protective layer. Examples of useful agents are lubricants such as zinc stearate, calcium stearate, polyethylene wax, carnauba wax, paraffin wax and ester wax; surfactants (dispersant or wetting agent) such as sodium dioctylsulfosuccinate; defoaming agents; polyvalent metal salts such as potassium alum and aluminum acetate. It is possible to use a curing agent such as glyoxal, boric acid, dialdehyde starch and epoxy compound in order to further enhance water resistance.

A coating composition for the protective layer is prepared by dispersing an aqueous binder together with as required the above specific benzotriazole compound, pigment, lubricant, etc., into a dispersion medium which is generally water.

The method of forming the protective layer is not limited specifically. The protective layer can be formed by various suitable coating methods mentioned as above, for example, by applying a coating composition for forming this layer to the heat sensitive recording layer, and drying the resulting coating. The amount of coating composition for the protective layer to be applied is adjusted to usually 0.5 to 15 g/m$^2$, preferably 1 to 7 g/m$^2$ based on dry weight, since a heat sensitive recording material will have a reduced record sensitivity with excess of 15 g/m$^2$ in coating amount.

In addition, it is possible as required to enhance the preservability of the recorded images by providing a protective layer also on the rear surface of the heat sensitive recording material. Furthermore, various kinds of techniques well known in the field of the heat sensitive recording materials may be applied as required. For example, it is possible to provide an undercoat layer between the substrate and the heat sensitive recording layer, to provide a smoothing process on each coated layer, for instance, by means of a supercalender, to coat an adhesive on the rear surface of the recording material so as to make it serviceable as adhesive labels, as well to form a magnetic recording layer, coating layer for printing, or heat transfer recording layer.

The present invention will be described in greater detail with reference to the following examples, to which the invention is not limited. The parts and percentages in these examples are by weight unless otherwise specified.

EXAMPLE 1

(1) Preparation of Composition A

A composition comprising 10 parts of 3-di-n-butylamino-6-methyl-7-anilinofluoran, 20 parts of 1,2-bis(3-methylphenoxy)ethane, 10 parts of 5% aqueous solution of methyl cellulose and 50 parts of water was pulverized to a mean particle size of 1.2 $\mu$m by a sand mill.

(2) Preparation of Composition B

A composition composed of 20 parts of 4-hydroxy-4'-isopropoxydiphenylsulfone, 10 parts of 5% aqueous solution of methyl cellulose and 30 parts of water was pulverized to a mean particle size of 1.2 μm by a sand mill.

(3) Preparation of Composition C

A composition composed of 10 parts of N,N'-bis[2-hydroxy-3-(2H-benzotriazol-2-yl)-5-methylbenzyl]-1,4-benzenedicarboxamide, 5 parts of 5% aqueous solution of methyl cellulose and 15 parts of water was pulverized to a mean particle size of 0.4 μm by a sand mill.

(4) Formation of Heat Sensitive Recording Layer

A coating composition for forming a heat sensitive recording layer was prepared by mixing together with stirring 90 parts of Composition A, 60 parts of Composition B, 80 parts of 10% aqueous solution of polyvinyl alcohol and 35 parts of calcium carbonate. The composition obtained was applied onto one surface of wood-free paper weighing 60 g/m$^2$ in an amount by dry weight of 6 g/m$^2$ and dried to form a heat sensitive recording layer.

(5) Formation of Protective Layer

A coating composition for a protective layer was prepared by mixing with stirring 30 parts of Composition C, 125 parts of 10% aqueous solution of acetoacetyl-modified polyvinyl alcohol (Gohsefimer Z-200, Nippon Synthetic Chemical Industry Co., Ltd.), 29 parts of kaolin (UW-90, Engelhard Corp.), 6 parts of 30% aqueous dispersion of zinc stearate and 30 parts of water. The coating composition obtained was applied to the above heat sensitive recording layer in an amount of 5 g/m$^2$ when dried, followed by drying and supercalendering to obtain a heat sensitive recording material.

EXAMPLE 2

A heat sensitive recording material was prepared in the same manner as in Example 1 except that in preparing Composition C, N,N'-bis[2-hydroxy-3-(2H-benzotriazol-2-yl)-5-methylbenzyl]-1,4-benzenedicarboxamide was replaced by N,N'-bis[2-hydroxy-3-(2H-benzotriazol-2-yl)-5-methylbenzyl]-1,3-benzenedicarboxamide.

EXAMPLE 3

A heat sensitive recording material was prepared in the same manner as in Example 1 except that in preparing Composition C, N,N'-bis[2-hydroxy-3-(2H-benzotriazol-2-yl)-5-methylbenzyl]-1,4-benzenedicarboxamide was replaced by N,N'-bis[2-hydroxy-3-(2H-benzotriazol-2-yl)-5-tert-butylbenzyl]-1,4-benzenedicarboxamide.

EXAMPLE 4

A heat sensitive recording material was prepared in the same manner as in Example 1 except that in preparing Composition A, 3-diethylamino-7-(m-trifluoromethylanilino)-fluoran was used in place of 3-di-n-butylamino-6-methyl-7-anilinofluoran.

EXAMPLE 5

A heat sensitive recording material was prepared in the same manner as in Example 1 except that in preparing Composition A, 3-(4-dimethylaminophenylamino)-5,7-dimethyl-fluoran was used in place of 3-di-n-butylamino-6-methyl-7-anilinofluoran.

EXAMPLE 6

A heat sensitive recording material was prepared in the same manner as in Example 1 except that in preparing Composition B, 4-hydroxy-4'-isopropoxydiphenylsulfone was replaced by bis(3-allyl-4-hydroxyphenyl)sulfone.

EXAMPLE 7

A heat sensitive recording material was prepared in the same manner as in Example 1 except that in preparing Composition B, 4-hydroxy-4'-isopropoxydiphenylsulfone was replaced by 2,4'-dihydroxydiphenylsulfone.

EXAMPLE 8

A heat sensitive recording material was prepared in the same manner as in Example 1 except that in preparing Composition B, 4-hydroxy-4'-isopropoxydiphenylsulfone was replaced by 4,4'-isopropylidenediphenol.

EXAMPLE 9

A heat sensitive recording material was prepared in the same manner as in Example 1 except that in preparing Composition C, the composition was pulverized to a mean particle size of 1.5 μm stead of 0.4 μm.

EXAMPLE 10

A heat sensitive recording material was prepared in the same manner as in Example 1 except that a heat sensitive recording layer was formed from a coating composition which was obtained by further adding 60 parts by weight of Composition C to the coating composition for the heat sensitive recording layer, and while a protective layer was formed from a coating composition which was obtained without use of Composition C.

COMPARATIVE EXAMPLE 1

A heat sensitive recording material was prepared in the same manner as in Example 1 except that a protective layer was formed from a coating composition which was obtained without use of Composition C.

COMPARATIVE EXAMPLE 2

A heat sensitive recording material was prepared in the same manner as in Example 1 except that in preparing Composition C, 2-(2'-hydroxy-5'-methylphenyl) benzotriazole was used in place of N,N'-bis[2-hydroxy-3-(2H-benzotriazol-2-yl)-5-methylbenzyl]-1,4-benzenedicarboxamide.

COMPARATIVE EXAMPLE 3

A heat sensitive recording material was prepared in the same manner as in Example 1 except that in preparing Composition C, 2,2'-methylenebis[4-(1,1,3,3-tetramethylbutyl)-6-(2H-benzotriazol-2-yl)phenol] was used in place of N,N'-bis[2-hydroxy-3-(2H-benzotriazol-2-yl)-5-methylbenzyl]-1,4-benzenedicarboxamide.

The heat sensitive recording materials thus obtained were evaluated by the following tests. The results are given in Tables 1 and 2.

[Color Forming Ability]

Images were recorded on the heat sensitive recording material by a heat sensitive recording tester [Model: TH-PMD, Ohkura Denki Co., Ltd., applied energy 0.45 mj/dot]. The color density of the recorded images thus obtained and the density of the unrecorded areas were measured in the visual mode by means of a Macbeth densitometer [Model: RD-914, Macbeth Corp.].

[Clarity of the Recorded Images]

The recorded images obtained from the above-mentioned evaluation of the color forming ability were visually checked for clarity (image quality). It is considered that the clarity generally reflects the magnitude of cloudiness of images which is caused by a whitening phenomenon or light scattering on the surfaces of fine particles of ultraviolet absorber.

Evaluation Criterion

◎: Recorded images are very clear.

○: Recorded images are clear.

Δ: Recorded images are slightly unclear.

x: Recorded images are unclear.

[Light Resistance]

The heat sensitive recording material which was recorded in the above-mentioned evaluation of the color forming ability was allowed to stand for 24 hours in a weather meter (Model: SUNSHINE XENON LONG LIFE WEATHER METER made by Suga Test Instruments Co. Ltd.) which was set at the conditions of light source: xenon, 63° C., 50% RH, and then the densities of the unrecorded areas and the recorded images were measured in the visual mode by means of the Macbeth densitometer.

[Plasticizer Resistance]

A polycarbonate pipe (40ϕ mm) pipe) was wrapped in a triple thickness with wrapping film [KMA-W made by Mitsui Toatsu Chemicals, Inc.] on which was placed the heat sensitive recording material which was recorded in the above-mentioned evaluation of the color forming ability, and both of them were further wrapped together with the wrapping film in a triple thickness, and then they were left to stand for 24 hours at a temperature of 40° C. Then, the density of the recorded images were measured by means of the Macbeth densitometer (in the visual mode) to evaluate the resistance to plasticizers.

[Oil Resistance]

The heat sensitive recording material which was recorded in the above-mentioned evaluation of the color forming ability was coated with food oil, and left to stand for 8 hours at room temperature. Then, the density of the recorded images was measured by means of the Macbeth densitometer (in the visual mode) to evaluate the resistance to oils.

[Solvent Resistance]

The surface of the recording material was wiped with a strip of gauze soaked with ethanol, and then the fogging was measured by means of the Macbeth densitometer to evaluate the resistance to solvents.

[Head Matching Ability]

The thermal head was visually checked for the adhesion of dirt (adhesion of tailings to the thermal head) which had continuously run recording for 200 mm during the above-mentioned evaluation of the color forming ability.

Evaluation Criterion

◎: No adhesion of tailings to the thermal head

○: A little adhesion of tailings to the thermal head but no problem practically x: Rather a lot of adhesion of tailings to the thermal head

TABLE 1

| | color density | | | light resistance | |
|---|---|---|---|---|---|
| | unrecorded area | recorded area | image quality | unrecorded area | recorded area |
| Ex.1 | 0.06 | 1.37 | ◎ | 0.09 | 1.30 |
| Ex.2 | 0.06 | 1.36 | ◎ | 0.09 | 1.29 |
| Ex.3 | 0.06 | 1.37 | ◎ | 0.09 | 1.30 |
| Ex.4 | 0.05 | 1.27 | ◎ | 0.08 | 1.24 |
| Ex.5 | 0.06 | 1.23 | ◎ | 0.06 | 1.21 |
| Ex.6 | 0.06 | 1.36 | ◎ | 0.09 | 1.29 |
| Ex.7 | 0.06 | 1.30 | ◎ | 0.09 | 1.23 |
| Ex.8 | 0.08 | 1.28 | ◎ | 0.10 | 1.20 |

TABLE 1-continued

| | color density | | | light resistance | |
|---|---|---|---|---|---|
| | unrecorded area | recorded area | image quality | unrecorded area | recorded area |
| Ex.9 | 0.06 | 1.32 | | 0.15 | 1.19 |
| Ex.10 | 0.06 | 1.35 | ◎ | 0.18 | 1.11 |
| Com.Ex.1 | 0.06 | 1.38 | ◎ | 0.27 | 0.87 |
| Com.Ex.2 | 0.06 | 1.23 | X | 0.14 | 1.04 |
| Com.Ex.3 | 0.06 | 1.27 | Δ | 0.11 | 1.18 |

TABLE 2

| | plasticizer resistance | oil resistance | solvent resistance | head matching ability |
|---|---|---|---|---|
| Ex.1 | 1.29 | 1.30 | 0.08 | ◎ |
| Ex.2 | 1.26 | 1.26 | 0.09 | ◎ |
| Ex.3 | 1.27 | 1.28 | 0.09 | ◎ |
| Ex.4 | 1.15 | 1.17 | 0.07 | ◎ |
| Ex.5 | 1.10 | 1.13 | 0.07 | ◎ |
| Ex.6 | 1.27 | 1.29 | 0.09 | ◎ |
| Ex.7 | 1.22 | 1.24 | 0.08 | ◎ |
| Ex.8 | 1.11 | 1.14 | 0.15 | ◎ |
| Ex.9 | 1.16 | 1.20 | 0.13 | ◎ |
| Ex.10 | 1.26 | 1.28 | 0.08 | ◎ |
| Com.Ex.1 | 1.29 | 1.30 | 0.08 | ◎ |
| Com.Ex.2 | 0.52 | 0.78 | 0.55 | X |
| Com.Ex.3 | 0.70 | 0.85 | 0.49 | |

EXAMPLE 11

A coating composition was prepared in the same manner as in Example 1 except that 60 parts by weight of Composition C was further added to the coating composition for the heat sensitive recording layer. The obtained coating composition was applied to one surface of wood-free paper weighing 60 g/m$^2$ in an amount by dry weight of 6 g/m$^2$, dried and supercalendered to obtain a heat sensitive recording material having no protective layer.

EXAMPLE 12

A heat sensitive recording material having no protective layer was prepared in the same manner as in Example 11 except that in preparing Composition A, 1-phenoxy-2-(2-naphthoxyethane) was used in place of 1,2-bis(3-methylphenoxy)ethane.

EXAMPLE 13

A heat sensitive recording material having no protective layer was prepared in the same manner as in Example 11 except that in preparing Composition A, 1,3-bis(2-naphthoxy)propane was used in place of 1,2-bis(3-methylphenoxy)ethane.

EXAMPLE 14

A heat sensitive recording material having no protective layer was prepared in the same manner as in Example 11 except that in preparing Composition A, 1-(2-naphthoxy)-2-(4-methylphenoxy)ethane was used in place of 1,2-bis(3-methylphenoxy)ethane.

EXAMPLE 15

A heat sensitive recording material having no protective layer was prepared in the same manner as in Example 11 except that in preparing Composition A, a mixture of di-p-methylbenzyl oxalate and di-p-chlorobenzyl oxalate (1:1) was used in place of 1,2-bis(3-methylphenoxy)ethane.

COMPARATIVE EXAMPLE 4

A heat sensitive recording material having no protective layer was prepared in the same manner as in Example 11 except that in preparing Composition C, 2-(2'-hydroxy-5'-methylphenyl)benzotriazole was used in place of N,N'-bis[2-hydroxy-3-(2H-benzotriazol-2-yl)-5-methylbenzyl]-1,4-benzenedicarboxamide.

The heat sensitive recording materials thus obtained were evaluated by the following tests. The results were given in Table 3.

[Color Forming Ability]

The same evaluation was made as above.

[Clarity of the Recorded Images]

The same evaluation was made as above.

[Light Resistance]

The same evaluation was made as above except that the sample was allowed to stand for 16 hours in the weather meter.

[Heat Resistance of Unrecorded Area]

The heat sensitive recording material before recording was placed in an oven at 80° C. for 24 hours and then the color density was measured by the Macbeth densitometer (in the visual mode).

TABLE 3

| | color density | | | light resistance | | heat re- |
|---|---|---|---|---|---|---|
| | recorded area | recorded area | image quality | unrecorded area | recorded area | sist-ance |
| Ex.11 | 0.05 | 1.39 | ◎ | 0.12 | 1.24 | 0.09 |
| Ex.12 | 0.05 | 1.40 | ◎ | 0.12 | 1.26 | 0.06 |
| Ex.13 | 0.05 | 1.38 | ◎ | 0.12 | 1.25 | 0.06 |
| Ex.14 | 0.05 | 1.36 | ◎ | 0.13 | 1.22 | 0.05 |
| Ex.15 | 0.05 | 1.40 | ◎ | 0.13 | 1.23 | 0.06 |
| Com. Ex.4 | 0.05 | 1.29 | Δ | 0.20 | 1.07 | 0.54 |

EXAMPLE 16

(1) Preparation of Composition D

A composition comprising 10 parts of 3-di-n-butylamino-6-methyl-7-anilinofluoran, 5 parts of 5% aqueous solution of methyl cellulose and 40 parts of water was pulverized to a mean particle size of 0.8 μm by a sand mill.

(2) Preparation of Composition E

A composition composed of 30 parts of 1,1-bis(4-hydroxyphenyl)-1-phenylethane, 5 parts of 5% aqueous solution of methyl cellulose and 80 parts of water was pulverized to a mean particle size of 1.2 μm by a sand mill.

(3) Preparation of Composition F

A composition composed of 20 parts of 1-phenoxy-2-(2-naphthoxy)ethane, 5 parts of 5% aqueous solution of methyl cellulose and 55 parts of water was pulverized to a mean particle size of 0.8 μm by a sand mill.

(4) Preparation of Composition G

A composition composed of 10 parts of N,N'-bis[2-hydroxy-3-(2H-benzotriazol-2-yl)-5-methylbenzyl]-1,4-benzenedicarboxamide, 20 parts of 10% aqueous solution of itaconic acid-modified polyvinyl alcohol and 50 parts of water was pulverized to a mean particle size of 0.4 μm by a sand mill.

(5) Formation of Heat Sensitive Recording Layer

A coating composition for forming a heat sensitive recording layer was prepared by mixing together with stirring 55 parts of Composition D, 115 parts of Composition E, 80 parts of Composition F, 80 parts of 10% aqueous solution of polyvinyl alcohol and 35 parts of calcium carbonate. The composition obtained was applied onto one surface of wood-free paper weighing 60 g/m$^2$ in an amount by dry weight of 5 g/m$^2$ and dried to form a heat sensitive recording layer.

(6) Formation of Protective Layer

A coating composition for a protective layer was prepared by mixing with stirring 80 parts of Composition G, 150 parts of 10% aqueous solution of acetoacetyl-modified polyvinyl alcohol, 30 parts of kaolin (UW-90, Engelhard Corp.), 3 parts of 10% aqueous solution of glyoxal, 6 parts of 30% aqueous dispersion of zinc stearate and 10 parts of water. The coating composition obtained was applied to the above heat sensitive recording layer in an amount of 4 g/m$^2$ when dried, followed by drying and supercalendering to obtain a heat sensitive recording material.

EXAMPLE 17 AND 18

Heat sensitive recording materials were prepared in the same manner as in Example 16 except that in preparing Composition D the following compounds were used in place of 3-di-n-butylamino-6-methyl-7-anilinofluoran.

Example 17: 3-di-n-butylamino-7-(o-chloroanilino) fluoran

Example 18: 3-diethylamino-7-(m-trifluoromethyl) anilinofluoran

COMPARATIVE EXAMPLE 5

A heat sensitive recording material was prepared in the same manner as in Example 16 except that a protective layer was formed from a coating composition which was obtained without use of Composition G.

COMPARATIVE EXAMPLES 6 AND 7

Heat sensitive recording materials were prepared in the same manner as in Example 16 except that in preparing Composition G the following compounds were used in place of N,N'-bis[2-hydroxy-3-(2H-benzotriazol-2-yl)-5-methylbenzyl]-1,4-benzenedicarboxamide.

Comparative Example 6: 2-(2'-hydroxy-5'-methylphenyl) benzotriazole

Comparative Example 7: 2,2'-methylenebis[4-(1,1,3,3-tetramethylbutyl)-6-(2H-benzotriazol-2-yl)phenol]

The heat sensitive recording materials thus obtained were evaluated by the following tests. The results were given in Tables 4 and 5.

[Color Forming Ability]

Images were recorded on the heat sensitive recording material by a heat sensitive recording tester [Model: TH-PMD, Ohkura Denki Co., Ltd., applied energy 0.50 mj/dot]. The color density of the recorded images thus obtained and the density of the unrecorded areas were measured in the visual mode by means of a Macbeth densitometer [Model: RD-914, Macbeth Corp.].

[Light Resistance]

The same evaluation was made as above except that the sample was allowed to stand for 24 hours in the weather meter.

[Heat Resistance]

The heat sensitive recording material which was recorded in the above-mentioned evaluation of the color forming ability was allowed to place for 16 hours in a hot air oven at 80° C. and then the color densities of the recorded images and the unrecorded areas were measured in the visual mode by means of a Macbeth densitometer.

[Plasticizer Resistance, Oil Resistance and Head Matching Ability]

The same evaluations were made as above.

TABLE 4

| | color density | | light resistance | |
|---|---|---|---|---|
| | unrecorded area | recorded area | unrecorded area | recorded area |
| Ex.16 | 0.07 | 1.32 | 0.10 | 1.26 |
| Ex.17 | 0.06 | 1.30 | 0.10 | 1.25 |
| Ex.18 | 0.07 | 1.31 | 0.11 | 1.25 |
| Com.Ex.5 | 0.07 | 1.33 | 0.30 | 0.95 |
| Com.Ex.6 | 0.07 | 1.29 | 0.17 | 1.13 |
| Com.Ex.7 | 0.07 | 1.28 | 0.15 | 1.15 |

TABLE 5

| | heat resistance | | plasti- | oil | head |
|---|---|---|---|---|---|
| | unrecorded area | recorded area | cizer resistance | resist- ance | matching ability |
| Ex.16 | 0.10 | 1.23 | 1.25 | 1.26 | ◎ |
| Ex.17 | 0.10 | 1.24 | 1.25 | 1.27 | ◎ |
| Ex.18 | 0.11 | 1.24 | 1.24 | 1.27 | ◎ |
| Com.Ex.5 | 0.10 | 1.23 | 1.24 | 1.28 | ◎ |
| Com.Ex.6 | 0.13 | 1.12 | 0.83 | 0.85 | X |
| Com.Ex.7 | 0.11 | 1.18 | 0.88 | 0.89 | X |

It is apparent from the results in Tables 1 and 2 that the heat sensitive recording material of the present invention is, not only outstanding in light resistance in the recorded and unrecorded areas, but excellent in the color forming ability, clarity of recorded images, plasticizer resistance, oil resistance, solvent resistance, and further in the head matching ability.

Furthermore, as is apparent from Table 3, the heat sensitive recording material of the present invention is, besides being provided with the recorded and unrecorded areas which are outstanding in light resistance, excellent in the color forming ability, and clarity of recorded images, and capable of forming an extremely low level of background fogging under elevated temperature environments.

It is apparent from the results in Tables 4 and 5 that the heat sensitive recording material of the present invention is, not only outstanding in light resistance and heat resistance in the recorded and unrecorded areas, but excellent in the chemical resistance and further in the head matching ability.

We claim:

1. A heat sensitive recording material comprising a heat sensitive recording layer formed on a substrate and containing an electron-donating compound and an electron-accepting compound, and a protective layer formed on the recording layer when required, the recording material being characterized in that at least one benzotriazole compounds represented by the formula (1) is incorporated into at least one of the heat sensitive recording layer and the protective layer (1)

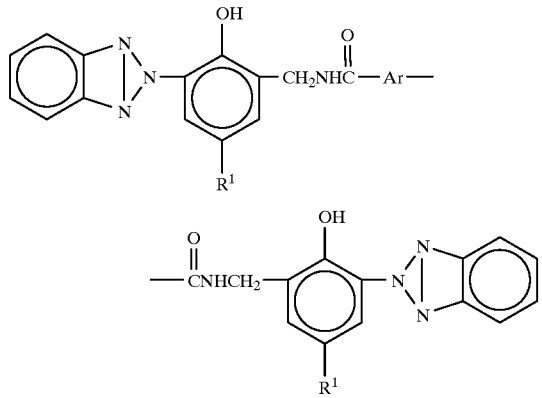

wherein $R^1$ is $C_{1\sim4}$ alkyl, Ar is 1,3-phenylene or 1,4-phenylene.

2. A heat sensitive recording material as defined in claim 1 wherein the electron-accepting compound is at least one of the diphenylsulfone derivative of the formula (2) below (2)

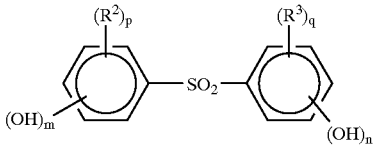

wherein $R^2$ and $R^3$ are each $C_{\sim}C_4$ alkyl, $C_2\sim C_4$ alkenyl, $C_1\sim C_4$ alkoxyl, benzyloxy or halogen atom, m is an integer of 0 to 2, n is an integer of 1 to 3, p and q are each an integer of 0 to 2.

3. A heat sensitive recording material as defined in claim 2 wherein the electron-accepting compound is 4-hydroxy-4'-isopropoxydiphenylsulfone, bis(3-allyl-4-hydroxyphenyl)-sulfone or 2,4'-dihydroxydiphenylsulfone.

4. A heat sensitive recording material as defined in claim 1 wherein the electron-accepting compound is 1,1-bis(4-hydroxyphenyl)-1-phenylethane.

5. A heat sensitive recording material as defined in claim 1 wherein the benzotriazole compound is N,N'-bis[2-hydroxy-3-(2H-benzotriazol-2-yl)-5-methylbenzyl]-1,4-benzenedicarboxamide.

6. A heat sensitive recording material as defined in claim 1 wherein the benzotriazole compound is incorporated into the protective layer.

* * * * *

UNITED STATES PATENT AND TRADEMARK OFFICE

CERTIFICATE OF CORRECTION

PATENT NO. : 5,935,900
DATED : August 10, 1999
INVENTOR(S) : Tatsuya MEGURO et al.

It is certified that error appears in the above-indentified patent and that said Letters Patent is hereby corrected as shown below:

Column 16, line 36, of claim 2, delete "$C_C_4$" and insert therefor --$C_1$~$C_4$--.

Signed and Sealed this

Eighth Day of February, 2000

*Attest:*

*Attesting Officer*

Q. TODD DICKINSON

*Commissioner of Patents and Trademarks*